US005685420A

United States Patent [19]

Martin et al.

[11] Patent Number: 5,685,420

[45] Date of Patent: Nov. 11, 1997

[54] COMPOSITE PACKAGING ARRANGEMENT FOR CONTACT LENSES

[75] Inventors: Wallace Anthony Martin, Orange Park; Kornelis Renkema; Victor Lust, both of Jacksonville, all of Fla.

[73] Assignee: Johnson & Johnson Vision Products, Inc., Jacksonville, Fla.

[21] Appl. No.: 414,516

[22] Filed: Mar. 31, 1995

[51] Int. Cl.[6] ..... A45C 11/00; B65D 85/00; B65D 5/38

[52] U.S. Cl. ..... 206/5.1; 206/497; 206/576; 206/820; 229/120.37; 229/122; 229/125.125

[58] Field of Search ..... 229/103.2, 122, 229/125.125, 235, 240, 120.37; 206/497, 499, 526, 5.1, 45.19, 820

[56] References Cited

U.S. PATENT DOCUMENTS

| | | | |
|---|---|---|---|
| 189,454 | 4/1877 | Goldbach | 229/125.125 X |
| D. 357,115 | 4/1995 | Abrams et al. | D3/264 |
| 2,184,854 | 12/1939 | Spooner | 229/120.37 X |
| 2,361,597 | 10/1944 | Buttery . | |
| 2,541,173 | 2/1951 | Moore | 229/125.125 X |
| 2,670,892 | 3/1954 | Kendrick | 229/122 X |
| 3,493,106 | 2/1970 | Galli | 206/497 |
| 3,605,374 | 9/1971 | Mueller et al. | 206/820 X |
| 3,721,339 | 3/1973 | Seyer | 229/235 X |
| 3,872,966 | 3/1975 | Gordon et al. | 206/499 X |
| 3,910,487 | 10/1975 | Jaeschke . | |
| 4,185,763 | 1/1980 | Geraedts | 229/125.125 X |
| 4,495,313 | 1/1985 | Larsen . | |
| 4,565,348 | 1/1986 | Larsen . | |
| 4,640,489 | 2/1987 | Larsen . | |
| 4,680,336 | 7/1987 | Larsen et al. . | |
| 4,691,820 | 9/1987 | Martinez . | |
| 4,889,664 | 12/1989 | Kindt-Larsen et al. . | |
| 4,986,414 | 1/1991 | Ashley et al. | 206/5.1 |
| 5,039,459 | 8/1991 | Kindt-Larsen et al. . | |
| 5,054,610 | 10/1991 | Ajello . | |
| 5,080,839 | 1/1992 | Kindt-Larsen . | |
| 5,094,609 | 3/1992 | Kindt-Larsen . | |

FOREIGN PATENT DOCUMENTS

| | | |
|---|---|---|
| 2 310 940 | 12/1976 | France . |
| 64-74525 | 3/1989 | Japan . |

*Primary Examiner*—Bryon P. Gehman

[57] ABSTRACT

A composite or secondary packaging arrangement for the containment of hydrophilic contact lenses in a sterile aqueous solution. More specifically disclosed is a composite or secondary packaging arrangement wherein pluralities of disposable hydrophilic contact lenses possessing different optical characteristics or prescriptions are contained in one or more specific packaging arrays which are then collectively housed in separate paired box-like compartments or carton structures in a preselected customized manner so as to provide specified or essentially measured supplies of differing contact lenses for prescribed use in both eyes of a consumer over a predetermined period of time.

35 Claims, 3 Drawing Sheets

COMPOSITE PACKAGING ARRANGEMENT FOR CONTACT LENSES

BACKGROUND OF THE INVENTION

1. Field of the Invention

The present invention relates to a composite or secondary packaging arrangement for the containment of hydrophilic contact lenses in a sterile aqueous solution. More specifically, the invention pertains to a composite or secondary packaging arrangement wherein pluralities of disposable hydrophilic contact lenses possessing different medical characteristics or prescriptions are contained in one or more specific packaging arrays which are then collectively housed in separate paired box-like containers or carton structures in a preselected customized manner so as to provide specified or essentially measured supplies of differing contact lenses for use in both eyes of a consumer over a predetermined period of time.

The packaging of hydrophilic contact lenses in a sterile aqueous solution is well known in the contact lens manufacturing technology. In particular, such packaging arrangements generally consist of so-called blister packages which are employed for the storage and dispensing of the hydrophilic contact lenses by a medical practitioner or to a consumer who intends to wear the contact lenses. Generally, such hydrophilic contact lenses, which may be disposable after a single wear or short-term use, are manufactured from suitable hydrophilic polymeric materials. These materials may be, amongst others, copolymers of hydroxyethyl methacrylate containing from about 20% to 90% or more of water, depending upon the polymer composition. Generally, such contact lenses must be stored in a sterile aqueous solution, usually in isotonic saline solution in order to prevent dehydration and to maintain the lenses in a ready-to-wear condition.

2. Discussion of the Prior Art

Heretofore, contact lens manufacturers normally utilized stoppered glass bottles containing sterile saline solutions in which the hydrophilic contact lenses were immersed as storage and shipping containers for individual contact lenses. Each bottle was sealed with a suitable silicone stopper and provided with a metal closure as a safety seal in the configuration of an overcap. When the contact lens was intended to be removed from the bottle for use by a patient, the metal closure safety seal was required to be initially torn off the bottle, thereafter the stopper withdrawn and the lens lifted out from the bottle through the intermediary of a suitable plastic tweezer or pouring the contents out. This entailed the implementation of an extremely complicated procedure, since the contact lens was difficult to grasp and remove from the saline solution contained in the bottle due to the transparent nature of the contact lens which rendered it practically invisible to the human eye.

More recently, containments in the form of blister packages have been developed for hydrophilic contact lenses, and which enable the storage and shipping of the hydrophilic contact lenses in a simple and inexpensive expedient manner, while concurrently facilitating the conveniently easy removal of the contact lens by a practitioner or a patient.

For instance, a blister package which is adapted to provide a sterile sealed storage environment for a disposable or single-use hydrophilic contact lens, wherein the lens is immersed in a sterile aqueous solution; for example, such as in an isotonic saline solution, is described in U.S. Pat. No. 4,691,820 to Martinez; which is assigned to the common assignee for the present invention, and the disclosure of which is incorporated herein by reference.

Thus, in the above-mentioned U.S. patent, the blister package for storing and dispensing a hydrophilic contact lens includes an injection-molded or thermoformed plastic base portion incorporating a molded cavity which is surrounded by an outstanding planar flange about the rim of the cavity. A flexible cover sheet is adhered to the surface of the flange so as to sealingly enclose the cavity in a generally liquid-tight mode. Within the cavity of the base portion, a hydrophilic contact lens is immersed in a sterile aqueous solution, such as an isotonic saline solution. A portion of the side wall of the cavity is inclined to form a ramp extending upwardly towards the flange from the bottom of the cavity, and the cover sheet is adapted to be stripped from the flange in order to expose the cavity and inclined side wall whereupon the lens may be readily manually removed by being slid upwardly and out of the cavity along the inclined ramp surface of the cavity.

A further improvement upon the versatility of blister package construction has been achieved in that the cavity in the base portion is constituted essentially of a semi-spherical configuration dimensioned so as to be adapted to closely support the contact lens therein while immersed in an aqueous solution for ease of removal and also to facilitate an inspection process. Moreover, the foregoing construction primarily considered the utilization of such blister packages for the dispensing of individual contact lenses, with such blister packages being ordinarily separate or single packagings, or arrays of specified interconnected blister packages which may then be housed in larger quantities within a further container, such as a rigid cardboard or paperboard carton construction employed for the retail sales of the lenses, and forming a composite or secondary packaging arrangement.

Accordingly, an important aspect resided in being able to furnish a user of such disposable hydrophilic contact lenses with a packaging arrangement, such as a carton, containing a specific supply of contact lenses, the latter of which are normally worn for only a single day; in essence, for ordinarily 8 to 18 hours within a 24-hour period and thereafter discarded. Hereby, the packaging of a supply of contact lenses was designed to enable the user to store and provide indication for replenishing the supply of contact lenses at regular intervals; for example, at periods of 30 days, although it can also be intended to provide containments or packages each containing supplies of the contact lenses for shorter or lengthier periods of days, weeks or even months. Consequently, the present invention contemplates the provision of composite or secondary packaging arrangements for specified quantities of such hydrophilic contact lenses, wherein these packaging arrangements incorporate boxing one or more arrays of blister packages containing contact lenses in a dual or twin carton structure each storing specific contact lenses for respectively the left and right eye of a user, enabling a rapid and precise determination as to the quantity of hydrophilic contact lenses contained therein, and with such packaging arrangements each being of a compact nature which is completely protective of the hydrophilic lenses.

In copending U.S. patent application Ser. No. 08/414,515 (Attorney's Docket No. VTN-170, 9014Z-II), which is commonly assigned to the assignee of this application and the disclosure of which is incorporated herein by reference, there are disclosed packaging arrangements in which a plurality of blister packages each having a semi-circular cavity containing respectively one hydrophilic contact lens in a sterile aqueous solution. A specified quantity of such blister packages has molded plastic base members thereof each containing a contact lens positioned in a contiguous array, and with the array being covered by a single flexible cover sheet constituted of a laminated foil or silicon oxide, or other suitable material structure to provide a sealed environment for each of the contact lenses contained in the cavity formed in each base member. Weakening lines are formed in the flexible cover sheet intermediate adjoining base members to enable detachment from the array of individual blister packages containing one of the hydrophilic contact lenses as may be required by a user.

In particular, a plurality of such arrays of continuous packaging arrangements for contact lenses, which arrays are in an interconnected planar form, are adapted to be arranged superimposed in a generally rectangular carton. Each successively superimposed array is inverted and rotationally reversed relative to a preceding underlying array so as to enable the respective arrays to be interleaved and compactly support each other. The cavities containing the contact lenses of a superimposed array are arranged inverted relative to the cavities of an array of blister packages located therebeneath or thereabove, such that the mutually inverted cavities will be positioned adjacent to cavities of a superimposed array in an interleaved compact arrangement at minimum spacial requirements. Consequently, a plurality of planar arrays of blister packages which are each respectively interconnected by a single flexible cover sheet for each array are adapted for positioning in a superimposed contacting relationship within a substantially rigid rectangular carton, with such arrays containing a specific quantity of disposable hydrophilic contact lenses to furnish a user with a desired supply; for instance, thirty (30) hydrophilic contact lenses in six superimposed arrays of five blister packages each; in essence, a thirty-day supply of contact lenses, although other quantities may also be readily contemplated depending upon the particular wishes of a consumer, such as 60-day or 90-day supply (3-month supply), or even in larger quantities, and as discussed in detail hereinbelow.

Each of the blister package base members has an outstanding substantially rigid planar flange encompassing a respective lens-receiving cavity therein, the latter of which is offset towards one end of the flange. The planar flange as disclosed herein, pursuant to a preferred embodiment, may possess a generally teardrop or wedge-shaped configuration; in effect, two converging side walls, the opposite ends of which extend into convex semi-circular end walls. Alternatively, the flange may have spaced sidewalls extending in parallel relationship in the form of a so-called "duckbill." Moreover, the narrow end of the flange remote from the lens-receiving cavity may be curved downwardly. The lens-receiving cavity is preferably formed offset towards the wider end of the respective planar flange, as described hereinbelow.

Furthermore, although the flange is described as being either teardrop or wedge-shaped in its planar extent, it is also possible to contemplate utilizing rectangular flanges for the base members of the blister packages which are interconnected in arrays of specific quantities by means of a single flexible cover sheet, such as described in copending U.S. patent application Ser. No. 08/257,796, filed Jun. 10, 1994; or even loosely located adjacent each other in predetermined arrays of blister packages.

Other configurations for the planar flange and/or base member of the blister package are also contemplatable. For instance, by way of example, the flange portion extending about the lens-containing cavity may be circular in shape and have a so-called spoon handle-like portion extending radially therefrom. Moreover, numerous further shapes for the base members and flanges readily suggest themselves; for example, as illustrated and elucidated in copending U.S. patent application Ser. No. 08/414,514 (Attorney's Docket No. VTN-171, 9014Z-III), the disclosure of which is incorporated herein by reference.

The presence of the flange is adapted to provide a support for a superimposed or therebeneath located array of blister packages, thereby formulating rigid and compact packaging arrangements within the carton, in which the cavities containing the hydrophilic contact lenses of superimposed arrays are substantially protected against potentially damaging external influences, such as shocks or impacts which may be imparted to the filled carton during handling thereof.

Each molded plastic base member of a blister package may be constituted from a suitable injection molded or thermoformed thermoplastic sheet material, such as a polyolefin, for instance polypropylene; whereas the flexible cover sheet may be constituted of a laminate of a polypropylene or other suitable plastic film and aluminum foil or with silicon oxide forming a barrier material with a plastic layer, suitably imprinted and which is adapted to be heat-sealed to the flange extending about the cavity of the package containing the hydrophilic contact lens. The flexible cover sheet may be of a construction and imprinted in a novel manner as disclosed in copending U.S. patent application Ser. No. 08/106,386; filed on Aug. 13, 1993; entitled "Method of Double-Sided Printing of a Laminate and Product Obtained Thereby", commonly assigned to the assignee of the present application and the disclosure of which is incorporated herein by reference.

SUMMARY OF THE INVENTION

Accordingly, in order to provide a versatility of contact lens packaging arrangements affording consumers a large variety of quantities and packagings in conformance with their particular intended use and requirements, the present invention pertains to the provision of novel composite or secondary packaging arrangements for the containment of hydrophilic contact lenses which are immersed in sterile aqueous solutions.

Pursuant to a specific embodiment, the secondary packaging may comprise rigid carton structure adapted to receive one or more arrays of interconnected blister packages each containing a hydrophilic contact lens, and whereby the arrays of blister packages are interconnected by flexible cover sheets, so as to be in either inverted or superimposed relationship in a compact stored position relative to each other whereby specific quantities of such superimposed or interleaved arrays are stored therein in a compact mode for maximum protection and availability or accessibility to an ultimate consumer.

Hereby, provision is made for such composite or secondary packagings or cartons containing one or more arrays of blister packages, whereby, in particular, pairs of such cartons are positioned in contiguous relationship and provided with a single overwrap or closure sleeve and whereby contact lenses may be provided in respectively each of the cartons; for example, lenses for the right and the left eye customized pursuant to medical prescriptions for the right and left eyes of the prospective user.

Moreover, it is also possible to contemplate providing a plurality of such pairs of composite or secondary packaging arrangements each consisting of respectively paired cartons to be combined and packaged being retained together by a shrinkwrap plastic film, so as to enable the formation of secondary packages of multiplicities of cartons containing larger quantities of lenses for use by a consumer, for example, such as a three-month supply of contact lenses for both the left and right eye which is practical and economical from a retail sales standpoint.

Moreover, pursuant to another aspect of the invention, rather than having discrete pluralities of arrays of blister packages contained in each carton forming the secondary packaging, such arrays may be constituted of a continuous array strip interconnected by the flexible cover sheet and containing a large number of blister packages, whereby the continuous array is folded in a sinusoidal pattern within each respective carton, so as to be able to be dispensed as individual separate blister packages in accordance with the needs of a user, upon each respective blister package being severed from an end of the array which is extended outwardly of the respective carton.

It is also possible to contemplate the provision of secondary packaging or carton structure in which the continuous array or strings of blister packages are adapted to be dispensed through a dispensing aperture formed in an end wall of the respective carton, and with the remaining blister packages of the array being protectively stored in the carton. In that connection two of such dispensing cartons are provided in a side-by-side position encompassed by a single cover member interconnecting the cartons, whereby each carton is adapted to store arrays of blister packages containing contact lenses specifically prescribed for respectively the left and the right eye of a particular patient or user. In this connection, each carton may be in the nature of a non-disposable dispenser, or may be constituted of a more durable housing; for instance, a plastic container or other material possessing a rigid design for the containment of the strings or arrays which are adapted to be sold to a physician or consumer, possibly separately from the containers.

Pursuant to another aspect of the invention, it is possible to contemplate the provisions of a foldable travel case in which the latter contains arrays of blister packages of contact lenses for both eyes of a user.

It is also possible to provide a compact-like case containing stowed arrays of contact lenses whereby the interior surface of a lid for the case may contain a mirror which is of assistance to a consumer when applying or removing a respective contact lens from the eye.

Accordingly, it is an object of the present invention to provide a novel composite or secondary packaging arrangement for the containment of arrays of blister packages each containing hydrophilic contact lenses in a sterile aqueous solution, and wherein the secondary packaging comprises interconnected carton structure for the supplying of different contact lenses.

Still another object of the present invention is to provide carton structure in which a pair or multiplicity of adjoiningly arranged cartons each contain at least one array of blister packages, and which are interconnected by a single cover member so as to enable the dispensing of individual contact lenses in a predetermined mode.

BRIEF DESCRIPTION OF THE DRAWINGS

Reference may now be had to the following detailed description of preferred embodiments of a composite or secondary packaging structure for the containment of arrays of blister packages, taken in conjunction with the accompanying drawings; in which.

DETAILED DESCRIPTION OF THE PREFERRED EMBODIMENTS

Figure 1:
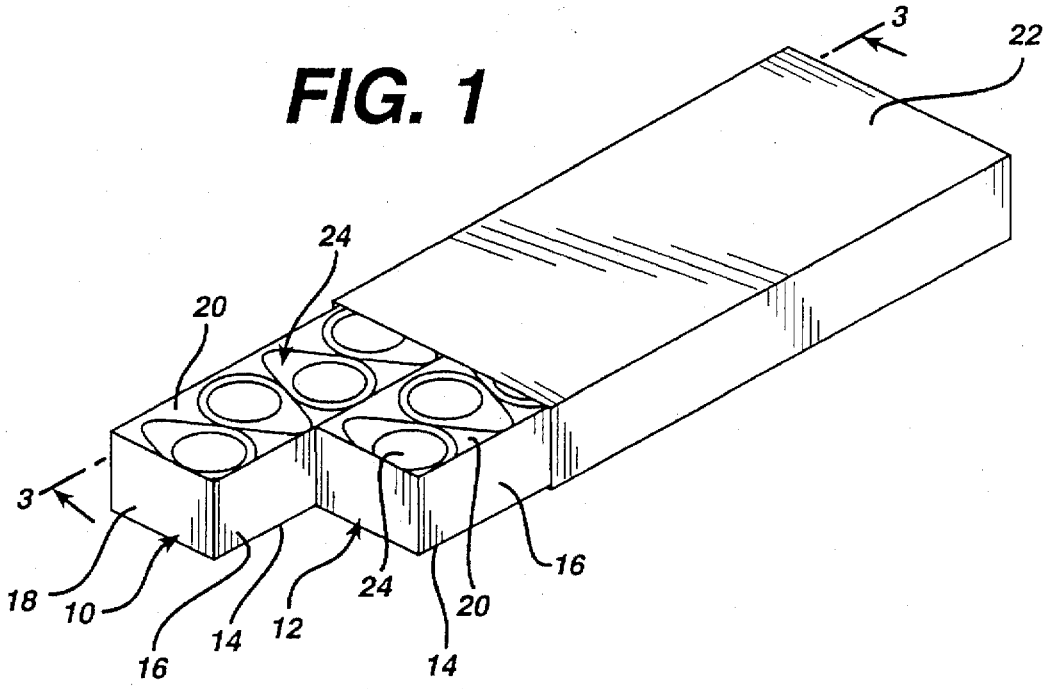
FIG. 1 illustrates a perspective view of a first embodiment of a secondary packaging arrangement pursuant to the invention comprising a pair of cartons each containing a supply of contact lenses, with the cartons being in side-by-side relationship and which are interconnected by a single closure member.

Referring in particular to FIG. 1 of the drawings, showing a perspective view of a secondary packaging arrangement, in this instance there is disclosed a pair of rectangular lower carton portions 10, 12 each having, respectively, bottom 14, side 16 and end walls 18 and evidencing an open top 20, and which cartons are adapted to be commonly closed by means of a sleeve-like cover member 22 which may have open ends or, if desired, closed ends adapted to be opened as needed so as to enable the lower carton portions 10, 12 having located therein arrays of blister packages 24 containing hydrophilic contact lenses to be selectively slid out from one end of the cover member 22 so as to enable separation and dispensing of individual of the blister packages therefrom. It is also possible to contemplate that the cover member 22 be constituted from a plastic shrinkwrap material rather than being formed from a rigid material. Alternative, the blister packages 24 may be individual in nature; in essence, no interconnected but merely located in specific arrays and/or loose layers in each lower carton portion 10, 12. This will enable dispensing of single blister packages 24 without the need for having to separate the package from the remaining arrays of blister packages in the cartons.

As shown in this instance, the arrays of blister packages in each of the cartons may comprise a plurality of adjacently arranged base members in coplanar orientation, similar to those shown in copending U.S. patent application Ser. No. 08/414,515 (Attorney's Docket No. VTN-170, 9014Z-II), interconnected by a flexible cover sheet so as to sealingly enclose the cavities containing the contact lenses in each of the base members of the blister packages. Hereby, suitable perforations may extend across the flexible cover sheet intermediate the adjoining wall portions of contiguous blister packages of the array so as to facilitate the separation of individual of the blister packages from the array for dispensing single contact lenses to a user.

Figure 2:
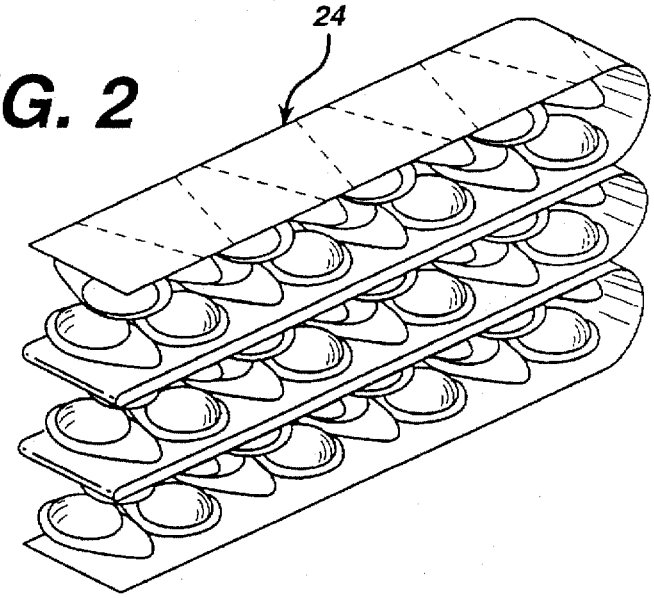
FIG. 2 illustrates a perspective and generally exploded diagrammatic view of a continuous strip-like array of interconnected blister packages adapted to be arranged in respectively one of the cartons of FIG. 1.
Figure 3:
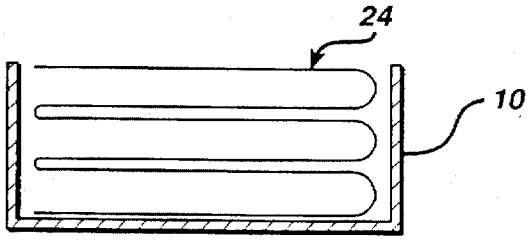
FIG. 3 illustrates a longitudinal sectional view taken along line 3—3 in FIG. 1 showing generally diagrammatically the arrangement of the array of blister packages of FIG. 2 within the carton structure.

With respect to the foregoing, although it is shown in FIG. 2 that each of the cartons contains a continuous sinusoidally folded strip or length array of the blister packages, rather than the foregoing, each of the arrays may consist of a predetermined limited number of coplanarly arranged base members interconnected by a length of flexible cover sheet in a manner as described in the aforementioned U.S. patent application Ser. No. 08/414,515 (Attorney's Docket No. VTN-170, 9014Z-II).

In the present instance, each carton 10, 12 contains a specific quantity of blister packages or arrays of blister packages intended to fulfill the needs of a user for a specified period of days or weeks. Each carton is adapted to contain contact lenses prescribed specifically for one eye, with contact lenses prescribed for respectively the left eye being stored in one carton 10, and those for the right eye in the other carton 12. The use of these two or dual interconnected containers 10, 12 may be such that in accordance with specific orders from a prospective user, the contents of the cartons may be customized prior to filling so as to fulfill the medical prescription for both eyes of a specific user, and whereby both types or prescription of contact lenses may thus be cosingle twin-or dual-cart single twin-or dual-carton packaging arrangement; in effect, consisting of the two cartons 10, 12 as enclosed by the single or common cover structure or member 22.

Figure 4:
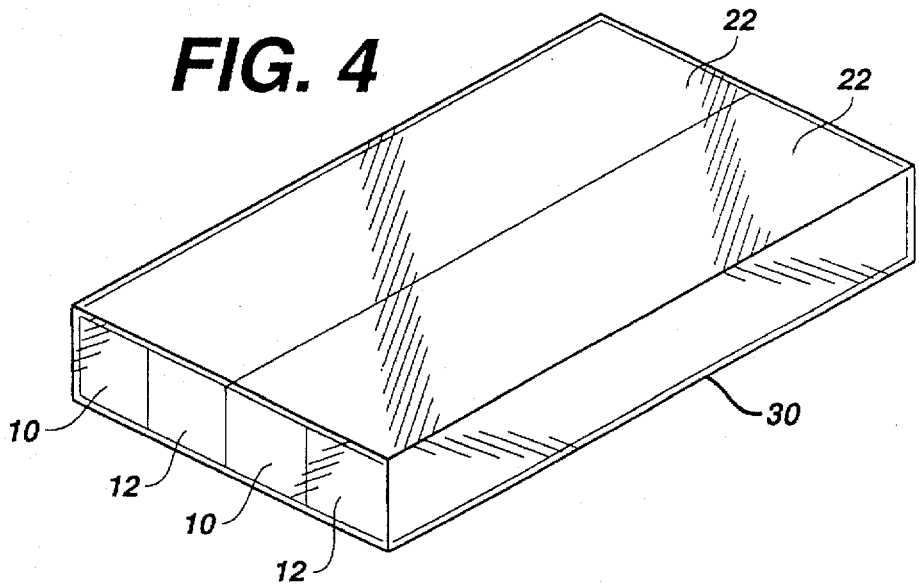
FIG. 4 illustrates a plurality of pairs of cartons as shown in FIG. 1 interconnected through the intermediary of a plastic shrinkwrap film.

Alternatively, as also shown in FIG. 4 of the drawings, a plurality of such pairs of cartons 10, 12, with each pair being enclosed by a common cover member 22 or being each of a closed construction having openable lids or flag structure, as shown in above-mentioned copending U.S. patent application Ser. No. 08/257,796, may, in turn, be encased by a suitable plastic shrinkwrap film 30 so as to enable larger quantities of product, for example, a three month's or even greater supply of contact lenses, to be shipped enclosed in one package for the convenience of the user or for a physician or optometrist prescribing and/or dispensing the lenses to the user. This will not only provide for convenience in shipping, but will also economize on packaging and shipping cost while rendering the entire arrangement attractive to a user.

Figure 5:
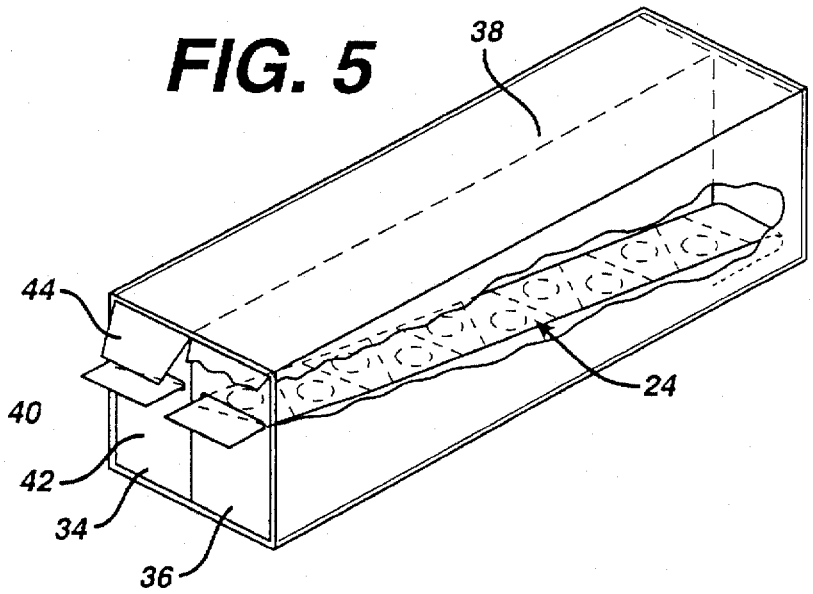
FIG. 5 illustrates a perspective generally diagrammatic view of a pair of interconnected secondary packaging arrangements in the form of cartons having dispensing orifices for respectively dispensing individual blister packages from a continuous array of such blister packages.
Figure 6:
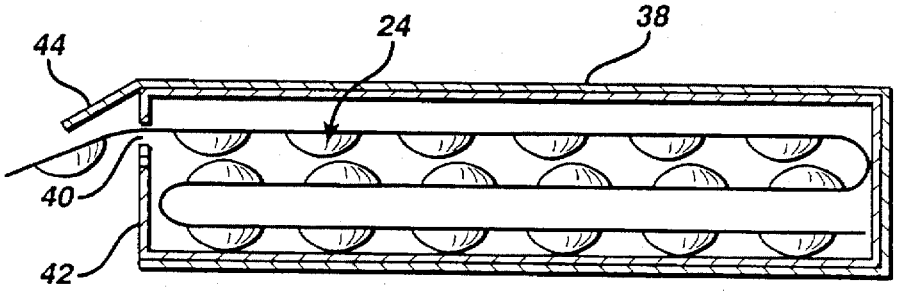
FIG. 6 is a sectional view taken along line 6—6 in FIG. 5.

Referring to FIGS. 5 and 6, there is disclosed a pair of side-by-side cartons 34, 36 encompassed by a single or common outer casing or wall structure 38, or enclosed by a shrinkwrap material, and with a dispensing slot 40 formed at one end 42 of respectively each carton, so as to enable the selective dispensing of individual blister packages from a continuous strip or array of such packages sinusoidally folded within each applicable carton, as shown in FIG. 4. This arrangement may be employed both for the left and right cartons and may be customized with regard to their contents in accordance with their left eye and right eye contact lens prescription of a potential user.

When dispensing of contact lenses is not currently required, a flap 44 positionable over the slot of each carton for dispensing individual and selective blister packages may be folded down and possibly closed off by means of a suitable latching arrangement, so as to protectively house the contents of the cartons when not in use.

Figure 7:
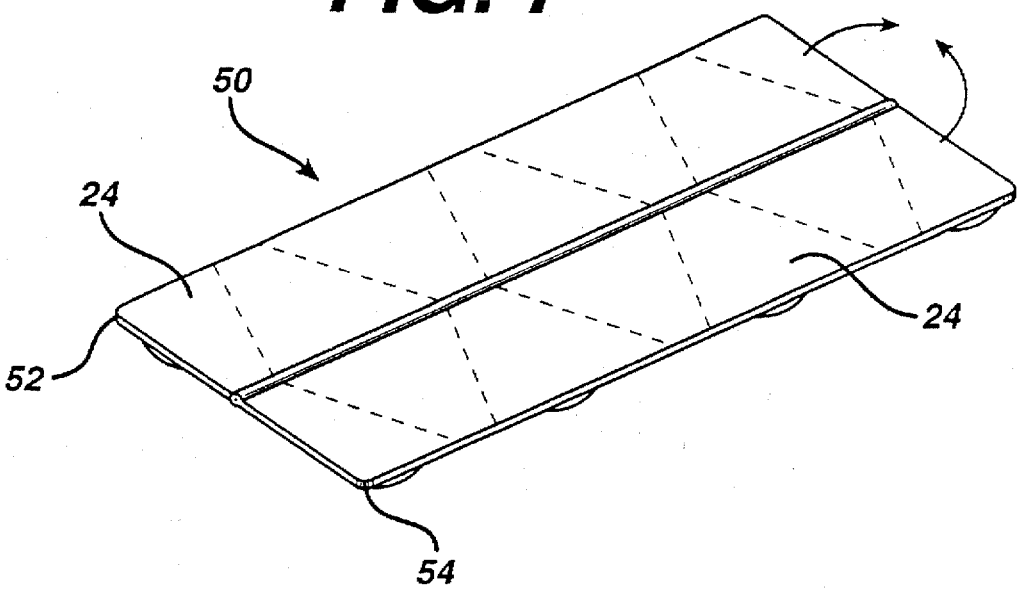
FIG. 7 illustrates a perspective view of a secondary packaging arrangement in the shape of a travel case.

Referring to FIG. 7, there is disclosed a travel case 50 consisting of hingedly foldable walls 52, 54, which may be constituted of paperboard, pressed cardboard or suitable plastic, or other even more durable containers constituted from other rigid materials such as wood or metal, and in which the interior thereof provides for a longitudinal hinge structure to enable for opening and closing, and with both walls having recessed configurations for receiving each an array of blister packages which are respectively interconnected by a length of the flexible cover sheet, and which are positioned in a back-to-back relationship when the travel case is folded shut about the hinging line along the direction of the illustrated arrows. This provides for an inexpensive and convenient method of transporting arrays of the blister packages when travelling without taking up too much space while concurrently being highly protective of the arrays of blister packages.

Figure 8:
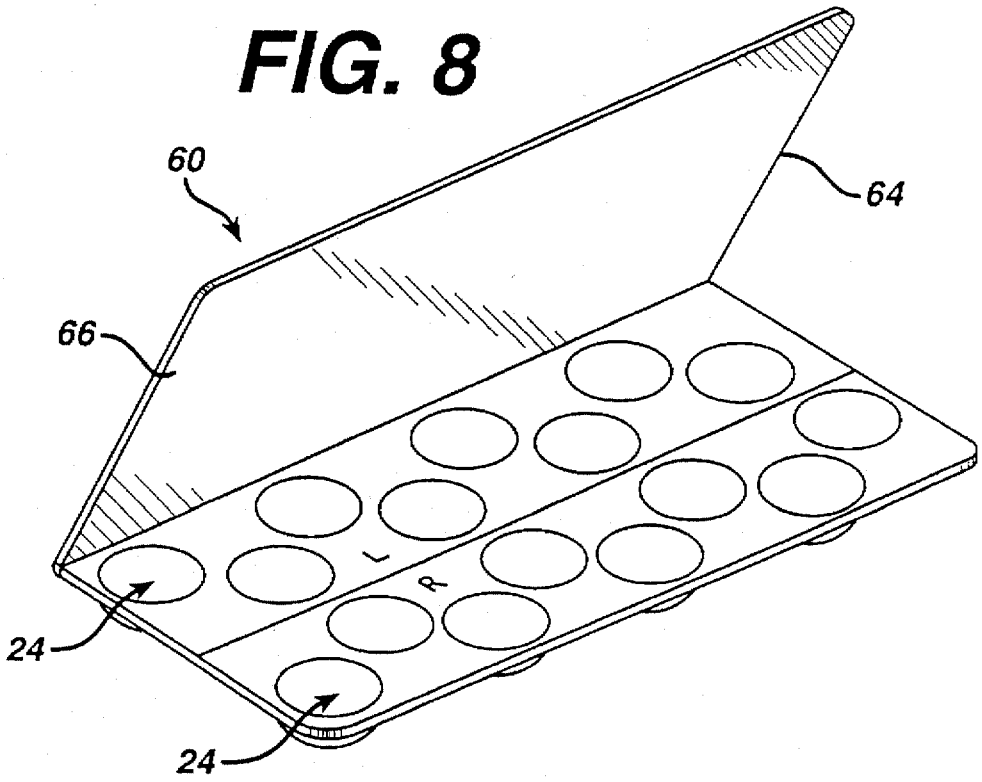
FIG. 8 illustrates a perspective view showing a mirrored compact case containing a plurality of arrays of blister packages.

Similarly, in FIG. 8 of the drawings, there is shown a generally rectangular compact case 60, which may be paperboard, pressed cardboard, molded from a plastic material, or consisting of more durable materials, such as wood or metal, and have decorative indicia provided thereon similar to a ladies' makeup compact case, and in which each side of the interior case includes a recess for stowing or housing an array of blister packages, each of which may selectively contain contact lenses for the left eye and right eye prescriptions of a user, and in which the inside surface of one wall or lid portion 64 may include a mirror 66 which will facilitate the efforts of a user in inserting a contact lens into the eye, or removing the lens therefrom.

The foregoing arrays housed in the dual cartons and containers enable the provision of numerous variations and quantities of contact lenses within respective differently sized carton structures and may be customized in accordance with instructions received in the shipping facility of the manufacturer from ophthalmologists, optometrists, or even from final users in accordance with their specifications as to quantities and the prescriptions of contact lenses contained in the various arrays of blister packages relative to the left and right eye of the ultimate user.

From the foregoing, there is obtained an extremely versatile secondary or composite packaging arrangement adapted to a wide variety of purposes and suitable for the specific needs of different consumers.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A composite packaging including a generally rigid containment having a plurality of paired compartments each containing at least one array of packaging arrangements housing hydrophilic contact lenses in a sterile aqueous solution, wherein the contact lens contained in one of said paired compartments differ from the contact lens contained in the other of said paired compartments; each said array comprising a plurality of molded plastic base members each having a cavity for containing a contact lens immersed in said solution and a flange extending about said cavity; and flexible cover sheet means superimposed on and extending over respectively each said base member and dimensioned to be detachably sealed to the surface of said flange, said cover sheet means sealingly extending about said cavity and having edge portions providing gripping means for enabling separating said cover sheet from said flange so as to expose said cavity and facilitating external access to the contact lens.

2. A composite packaging as claimed in claim 1, wherein said rigid containment comprises a carton having first and second packaging array-receiving carton portions each possessing at least one of said paired compartments; and a closure member encompassing said carton portions in the inserted conditions thereof and enabling selective manipulation of said carton portions to enable access to the at least one array of packaging arrangements contained therein.

3. A composite packaging as claimed in claim 2, wherein said closure member comprises a sleeve having at least one openable end to facilitate selective manipulation and insertion therein of said carton portions.

4. A composite packaging as claimed in claim 2, wherein each said carton portion comprises an upwardly open rectangular box structure.

5. A composite packaging as claimed in claim 4, wherein said box structures are positioned in a side-by-side arrangement within said closure member.

6. A composite packaging as claimed in claim 2, wherein said closure member is constituted of paperboard.

7. A composite packaging as claimed in claim 2, wherein said closure member is constituted of pressed cardboard.

8. A composite packaging as claimed in claim 2, wherein said closure member is constituted of molded plastic material.

9. A composite packaging as claimed in claim 2, wherein said closure member is constituted of durable materials.

10. A composite packaging as claimed in claim 2, wherein said closure member is constituted of plastic shrinkwrap film.

11. A composite packaging as claimed in claim 2, wherein said at least one array located in each said respective carton portion is positioned as in a continuous sinusoidally folded strip of interconnected packaging arrangements.

12. A composite packaging as claimed in claim 2, wherein a plurality of superimposed arrays are located in each said respective carton portion.

13. A composite packaging as claimed in claim 1, wherein said at least one array comprises two separate arrays of packaging arrangements arrayed in interleaved manner in each said compartment whereby said cavities of one of said separate arrays are positioned facing said cavities of the other of said two separate arrays.

14. A composite packaging as claimed in claim 1, wherein said rigid containment comprises a rectangular carton having first and second said compartments, each said compartment having a dispensing orifice for the withdrawal and severing of individual of said packaging arrangements from a respective one of said compartments.

15. A composite packaging as claimed in claim 14, wherein said compartments are positioned in a side-by-side arrangement in said carton, each said orifice being formed in an end wall of said carton and communicating with a respective one of said compartments.

16. A composite packaging as claimed in claim 15, wherein openable flap means covers each respective orifice to protect the array in said compartments during storage therein.

17. A composite packaging as claimed in claim 15, wherein each said array in each respective said compartment comprises a continuous sinusoidally folded strip of interconnected packaging arrangements adapted to be drawn out through said orifice for selectively dispensing individual of said packaging arrangements.

18. A composite packaging as claimed in claim 1, wherein means further comprising in combination at least one additional containment connected to the first said containment by interconnecting means.

19. A composite packaging as claimed in claim 18, wherein said interconnecting means comprises a shrinkwrap film encompassing said containments.

20. A composite packaging as claimed in claim 1, wherein said containment is formed of a material selected from the group of materials consisting of paperboard, pressed cardboard, molded plastic, wood and metal materials.

21. A composite packaging as claimed in claim 1, wherein said containment comprises a hingedly connected folding structure having packaging array-stowing recess portions.

22. A composite packaging as claimed in claim 21, wherein said containment comprises a travel case.

23. A composite packaging as claimed in claim 21, wherein said containment comprises a compact having at least one mirrored inner wall surface and a recess portion for stowing at least one said packaging array.

24. A composite packaging as claimed in claim 1, wherein each base member includes a flange extending between a wide end and a narrow end said cavity being located proximate the wide end of said flange and said flange extending outwardly about the periphery of said cavity, said cavity consisting of a concave indentation in said base member and having a shape in substantial conformance with the shape of the contact lens adapted to be contained therein, said base member of said at least one array being oriented such that the cavity of a base member is adapted to be arranged adjacent the narrow end of respectively an adjacently located base member in an alternatively disposed manner.

25. A composite packaging as claimed in claim 24, wherein each said flange has a generally planar surface configuration facing said superimposed cover sheet means in contacting relationship.

26. A composite packaging as claimed in claim 24, wherein a releasable seal is formed between said cover sheet means and the planar surface of each said flange sealingly encompassing the peripheral edge of each said cavity.

27. A composite packaging as claimed in claim 26, wherein said seal comprises a heat seal.

28. A composite packaging as claimed in claim 1, wherein each said molded plastic base member is constituted of a thermoformable plastic material.

29. A composite packaging as claimed in claim 1, wherein said flexible cover sheet means is a multi-layered foil laminate having an outer layer of said laminate consisting of a plastic film contacting the surface of the flanges of each of said molded plastic base members.

30. A composite packaging as claimed in claim 29, wherein said plastic film is heat sealed to said flange surface of each said molded plastic base member for sealing each cavity containing the contact lens.

31. A composite packaging as claimed in claim 1, wherein said molded plastic base members and said flexible cover sheet means conjointly form moisture and vapor-imperviously sealed containments for said contact lenses in each of said cavities.

32. A composite packaging as claimed in claim 1, wherein said plurality of said base members are contiguously arranged and detachably interconnected in said at least one array by said flexible cover sheet means for the containment of a specified number of said contact lenses.

33. A composite packaging as claimed in claim 32, wherein said flexible cover sheet means connects said plurality of base members in a coplanar array.

34. A composite packaging as claimed in claim 33, wherein weakening lines are formed in said flexible cover sheet means intermediate each of said adjacently arranged base members of said at least one array to enable separating said plurality of base members into individual packaging arrangements each consisting of a single base member.

35. A composite packaging as claimed in claim 34, wherein said plurality of base members are separable into individual blister packages each containing a single contact lens.

* * * * *